US009784536B2

(12) United States Patent
Boswell

(10) Patent No.: US 9,784,536 B2
(45) Date of Patent: Oct. 10, 2017

(54) WEAPON LIGHT MOUNT

(71) Applicant: Jason William Boswell, Yulee, FL (US)

(72) Inventor: Jason William Boswell, Yulee, FL (US)

( * ) Notice: Subject to any disclaimer, the term of this patent is extended or adjusted under 35 U.S.C. 154(b) by 0 days.

(21) Appl. No.: 14/684,585

(22) Filed: Apr. 13, 2015

(65) Prior Publication Data

US 2015/0316355 A1 Nov. 5, 2015

Related U.S. Application Data

(60) Provisional application No. 61/978,849, filed on Apr. 12, 2014.

(51) Int. Cl.
*F41G 11/00* (2006.01)
*F41G 1/35* (2006.01)

(52) U.S. Cl.
CPC ..... *F41G 11/004* (2013.01); *F41G 1/35* (2013.01); *F41G 11/003* (2013.01)

(58) Field of Classification Search
CPC ..... F41G 1/34; F41G 1/35; F41G 1/00; F41G 11/001; F41G 11/003; F41G 11/004; F41G 11/005
USPC ..... 42/146, 84, 72, 85, 114, 115, 90, 124; 362/110
See application file for complete search history.

(56) References Cited

U.S. PATENT DOCUMENTS 5,107,612 A * 4/1992 Bechtel ..... F41G 11/003 42/115
5,913,669 A * 6/1999 Hansen ..... F41G 1/36 362/110
6,023,875 A * 2/2000 Fell ..... F41C 23/22 362/114
6,568,118 B1 * 5/2003 Teetzel ..... F41G 1/36 42/105
7,219,370 B1 * 5/2007 Teetzel ..... A42B 3/04 2/422
7,438,430 B2 * 10/2008 Kim ..... F41G 1/34 200/18
7,609,005 B2 * 10/2009 West ..... F21L 4/005 315/200 A
7,627,975 B1 * 12/2009 Hines ..... F41C 23/16 42/84
7,845,105 B1 * 12/2010 Cahill ..... F41C 23/16 200/86 R
7,975,419 B2 * 7/2011 Darian ..... F41C 27/00 42/84
8,104,211 B2 * 1/2012 Darian ..... F41C 23/22 362/110
8,132,355 B1 * 3/2012 Kincaid ..... F41C 33/0254 362/110
8,220,946 B1 * 7/2012 Teetzel ..... F41C 27/00 362/110

(Continued)

*Primary Examiner* — John D Cooper
(74) *Attorney, Agent, or Firm* — Jonathan R. Smith; Jonathan Rigdon Smith, J.D., PC

(57) ABSTRACT

An accessories mount, for weapons equipped with a tactical rail, comprises a quick-release clamp for a light and a pressure switch for actuating the light. This enables one light to be used on multiple weapons and to be readily mounted or de-mounted for charging the battery(ies) or using unattached to a firearm. The light may also be recharged while still clamped to the mount.

2 Claims, 3 Drawing Sheets

(56) References Cited

U.S. PATENT DOCUMENTS 8,225,544 B2 * 7/2012 Darian ..... F41C 23/22 362/110
8,322,064 B2 * 12/2012 Cabahug ..... F41C 23/22 42/71.01
8,402,683 B2 * 3/2013 Cabahug ..... F41C 23/04 42/71.01
8,443,539 B2 * 5/2013 Cabahug ..... F41C 23/22 42/71.01
8,448,368 B2 * 5/2013 Cabahug ..... F41G 11/003 42/71.01
8,459,822 B1 * 6/2013 Lambert ..... F41G 1/473 362/110
8,516,731 B2 * 8/2013 Cabahug ..... F41C 23/22 42/124
8,769,856 B2 * 7/2014 Berntsen ..... F41C 23/16 42/84
8,850,735 B2 * 10/2014 Kenney ..... F41A 3/66 42/106
8,908,045 B2 * 12/2014 Stewart ..... H04N 5/225 348/169
8,944,626 B2 * 2/2015 Matthews ..... F21V 23/0414 362/109
9,086,253 B2 * 7/2015 Oh ..... F41C 23/22
9,285,185 B2 * 3/2016 Cabahug ..... F41C 23/22
9,291,430 B2 * 3/2016 Clark
2005/0246937 A1 * 11/2005 Kim ..... F41G 11/003 42/146
2007/0070619 A1 * 3/2007 Galli ..... F21V 21/084 362/157
2007/0266612 A1 * 11/2007 Kim ..... F41G 11/003 42/127
2008/0134562 A1 * 6/2008 Teetzel ..... F41G 11/003 42/146
2009/0044439 A1 * 2/2009 Phillips ..... F41C 23/14 42/72
2009/0084016 A1 * 4/2009 Wu ..... F41G 1/35 42/90
2010/0242332 A1 * 9/2010 Teetzel ..... F41A 23/08 42/72
2011/0076095 A1 * 3/2011 Storch ..... F41C 27/00 403/322.4
2011/0185617 A1 * 8/2011 Brixius ..... F41C 23/16 42/71.01
2011/0261559 A1 * 10/2011 Couture ..... F21L 4/005 362/184
2012/0055061 A1 * 3/2012 Hartley ..... F41C 23/16 42/84
2012/0266514 A1 * 10/2012 Michal ..... F41C 23/16 42/90
2013/0061504 A1 * 3/2013 Malherbe ..... F41G 11/003 42/84
2013/0312309 A1 * 11/2013 Rorick ..... F41G 11/003 42/114
2014/0003862 A1 * 1/2014 Shi ..... F16M 13/022 403/322.4
2014/0007485 A1 * 1/2014 Castejon, Sr. ..... F41G 1/35 42/117
2014/0092588 A1 * 4/2014 Toman ..... F41G 11/003 362/110
2014/0305022 A1 * 10/2014 Chung ..... F41G 1/16 42/113
2015/0113851 A1 * 4/2015 Bensayan ..... F41A 17/063 42/117
2015/0143734 A1 * 5/2015 Ley ..... F41A 35/00 42/146
2015/0247700 A1 * 9/2015 Merlino ..... F41C 23/16 42/75.01
2015/0316355 A1 * 11/2015 Boswell ..... F41G 1/35 42/146
2016/0033232 A1 * 2/2016 Cheng ..... F41G 1/345 42/114

* cited by examiner

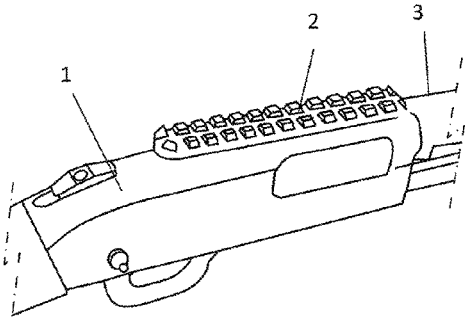
FIG. 1
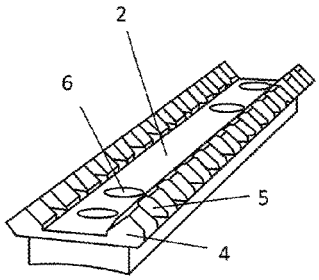
FIG. 2
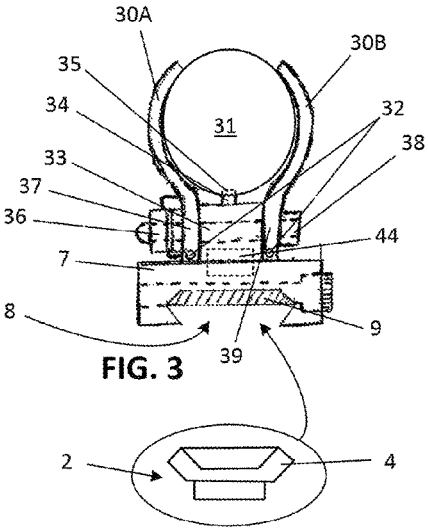
FIG. 3
FIG. 3A
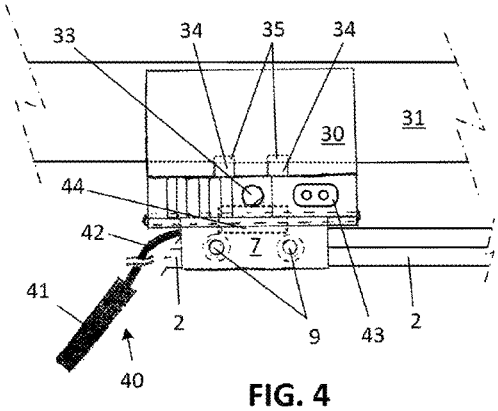
FIG. 4
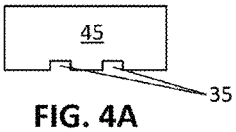
FIG. 4A
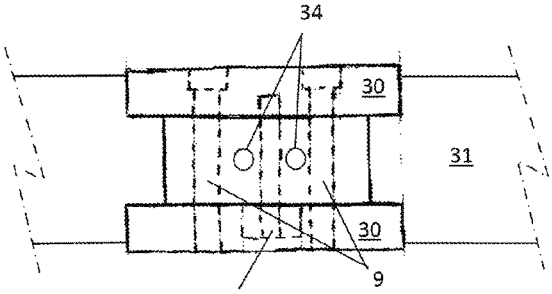
FIG. 5

WEAPON LIGHT MOUNT

CROSS-REFERENCES TO RELATED APPLICATIONS

This U.S. non-provisional patent application claims priority of U.S. Provisional Application No. 61/978,849 filed Apr. 12, 2014.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A BIOLOGICAL SEQUENCE LISTING

Not applicable.

BACKGROUND OF INVENTION

Field of the Invention

This invention is in the field of firearms, more specifically accessories for firearms, and still more specifically removable and interchangeable accessories. In the field of firearm accessories, this invention is specifically related to illuminating a target area. The invention is also in the field of lighting, more specifically portable, rechargeable or battery-powered lighting for use by individuals.

Description of the Related Art

As to portable lights themselves, several companies make rechargeable hand-held lights. The most useful configuration for a light in the general context of the use of this invention (aiming a firearm at night and performing searches) is a cylindrical body with a tail-cap switch, represented by most of the tactical lights on the market. A tail-cap switch is typically a momentary-on switch, that is, one that momentarily closes a direct electrical circuit between the battery and the light bulb.

A pressure switch differs from a tail-cap or other toggle switch in that an air or liquid filled bulb is squeezed by the fingers and transmits the fluid pressure through a slender flexible tube to a membrane. The membrane toggles the electrical contact without the fingers having to touch the light.

Fast and easy mounting and de-mounting of accessories on firearms, especially long guns, is currently accomplished by the use of tactical rails such as the Picatinny rail or the Weaver rail bolted to the top surface of the firearm near the rear of the barrel. The accessories themselves are therefore equipped with mounts secured to a bottom part of the accessory which are shaped to slide on and off the rail. Hence, for fast and easy mounting of a light, it is essential that the light be mountable and de-mountable on a tactical rail in a way that scopes are. Most weapon-mounted lights attach to the mount by a bracket or clamp. They are typically powered by non-rechargeable batteries which can be replaced in situ; the lights are not intended to be removed from the mount on a regular basis. They are operated by a switch on board the light housing such as a tail-cap switch or a remote pressure switch as described above.

Some portable lights have a two-prong interface which mates with charging pads in a recharging cradle. It would be possible to fit certain cylindrical flash lights into a scope mount, but to mount such a light in a scope mount would require unscrewing the scope ring bolts, de-mounting the scope, placing the light within the rings, and refastening the scope rings. To remove it for charging or use on another system the user would have to repeatedly unscrew the scope rings. Apart from being less than convenient, repeated separation and assembly will strip the screws and/or the rings. Such lights also do not have pressure switch functionality.

Some portable light manufacturers offer a remote pressure switch that can be used in lieu of the original tail-cap switch. This flexibility becomes a liability because when you detach the light, the pressure switch is no longer a practical switch and gets in the way.

BRIEF DESCRIPTION OF THE INVENTION

Objects of the Invention

A first object of the invention is to provide a rail-mountable light, the light also providing a quick release from the mount. A second object is to provide a mount with its own pressure switch that utilizes a quick release clamp mechanism to mate the light with a mount for semi-permanent attachment to a tactical rail. A third object of the invention addresses the need for a reliable connection through the mount between the light and the pressure switch. A fourth object of the invention is to provide charging contacts on the mount that mate with contact pads on a charger in addition to interfacing with switch contacts on the light. A fifth object of the invention allows for the retention of the original tail-cap switch, should the pressure switch be damaged (a kind of back-up on/off to complete the mission before repairing or replacing the damaged part).

SUMMARY OF THE INVENTION

An accessories mount, for weapons equipped with a tactical rail, comprises a quick-release clamp for a light and a pressure switch for actuating the light. This enables one light to be used on multiple weapons and to be readily mounted or de-mounted for charging the battery(ies) or using unattached to a firearm. The light may also be recharged while still clamped to the mount.

BRIEF DESCRIPTION OF THE DRAWINGS

FIG. 1 shows a portion of a rifle equipped to mount accessories on a tactical rail.

FIG. 2 shows a type of tactical rail known as a Picatinny rail.

FIG. 3-3A is an end view of the first embodiment of the invention.

FIG. 4 is a side view of the first embodiment.

FIG. 5 is a top view of the first embodiment.

DETAILED DESCRIPTION OF THE INVENTION

Figure 6:
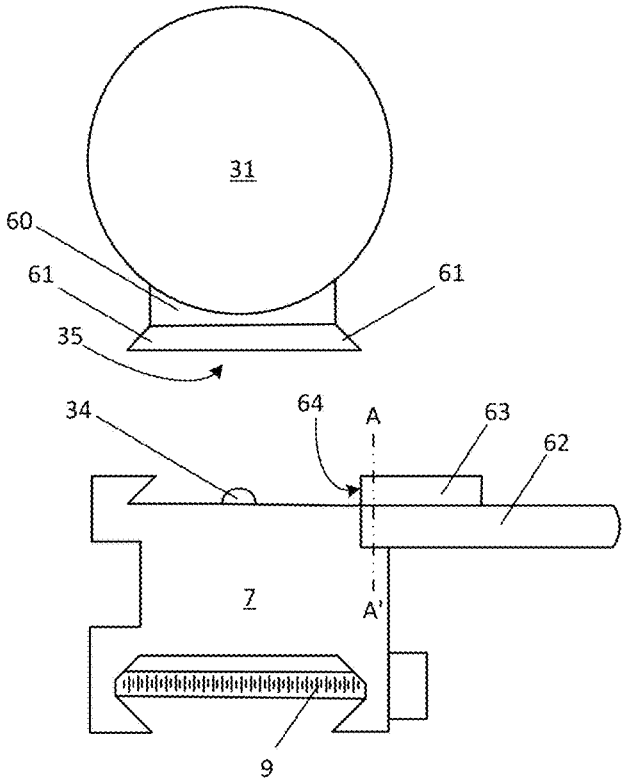
FIG. 6 is an end view of the second embodiment of the invention using as alternative means for affixing the light, with the means in the open position.

Referring now to the drawings, in which like reference characters refer to like elements among the drawings, FIG. 1 shows a portion of a rifle 1 equipped with a Picatinny tactical rail 2 on its upper surface 3 upon which to mount accessories.

FIG. 2 shows a Picatinny rail 2 with diamond-shaped flanges 4 extending laterally from both sides of the rail. The flanges 4 are separated by clinch bolt spaces 5. Countersink holes 6 can be seen enabling the rail 2 to be bolted to the rifle.

FIG. 3 is an end view of the first embodiment of the invention, namely, the weapon light mount. It comprises a rail clinch 7 with a flange groove 8 underneath. One of a plurality of rail clinch bolts 9 can be seen extending from right to left in this view. (One or more like bolts are hidden behind this one in this view.) Flange groove 8 is shaped to slide endwardly onto the rail flanges 4 (see inset end view FIG. 3A of rail 2 and flanges 4) when the clinch bolts 9 are removed. The mount can then be positioned anywhere along the length of the rail 2 and secured in place when the clinch bolts 9 are reinserted through appropriate clinch bolt spaces (see 5 in FIG. 2) and tightened.

Other mounting rails to which a clinch may be secured are included within the scope of this invention without limitation.

Also in FIG. 3, a pair of light clamps 30A and 30B is displayed clamping light 31. The lower ends of the clamps 30 are hinged to clinch 7 by hinges 32 so that when tension clamp bolt 33 is tightened, light 31 will remain in fixed alignment relative to the firearm (see 1 in FIG. 1). As depicted here, tension clamp bolt 33 may quickly loosened and tightened by a knurled nut 36. Alternatively, the desired speed of removal and re-installation may also be achieved in this invention by biasing clamps 30A and 30B towards each other, for example and not by limitation, inserting a biasing means such as a spring between nut 36 and lower end 37 of left light clamp 30A and/or between bolt head 38 and lower end 39 of the right light clamp 30B, so that light 31 can be released from between the clamps by pulling the light 31 upwardly.

FIG. 3 also shows one of two contact points 34 abutting contact pads 35 in the bottom of light 31 to enable a pressure switch (see FIG. 4) to close the electrical circuit between the battery(ies) 44 and bulb (not shown) within light 31. The actual position of the points 34 and the pads 35 can be positioned in locations other than those depicted here and still be within the scope of this invention as long as contact between them is enabled. In an alternate embodiment, the contact pads 35 may also be configured and wired so as to enable the light 31 to be recharged in a separate charger when removed from the invention. The scope of this invention does not limit the mount contacts to "points" or the light contacts to "pads" as long as the mating contacts are shaped to provide reliable and durable contact. For example, some contacts are spring-loaded to improve contact and/or equipped to produce an audible click indicating proper engagement.

FIG. 4 is a side view of the first embodiment. It shows light 31 clamped between clamps 30 (only one of which is visible) as a result of tightening tension clamp bolt 33. This view also shows two clinch bolts 9 binding rail clinch 7 to tactical rail 2. Pressure switch 40 is shown here arranged to transfer pressure from squeezing pressure bulb 41 through flexible tube 42 into clinch 7, where a mechanism allows the pressure pulse to toggle a switch (not visible) closing the electrical circuit between the battery(ies) 44 and bulb (not shown) within light 31. The use of a switch connected to the clinch by a flexible means is highly desirable because there are situations in which it is necessary to turn the light on without consequence, that is, without making noise or changing the aim of the weapon. Other types of switches that meet this requirement, such as, but not limited to, sealed cable releases, as well as switches other than toggle switches, are included within the scope of this invention without limitation. This invention also includes a clinch 7 containing a switch that can be remotely actuated, as by, e.g., an IR or RF remote, without limitation.

Also visible on the side of FIG. 4 is an input connector 43 for direct power to the light, or, in the case of a clinch 7 that contains a rechargeable battery 44, recharging power.

FIG. 5 is a top view of the first embodiment. Light 31 is not shown in this view to make visible the two contact points 34, the rail clinch bolts 9 and the tension clamp bolt 33.

FIG. 6 is an end view of the second embodiment of the invention, which uses an alternative means for affixing the light 31 to the rail clinch 7. The light-affixing means is shown in the open position. Light 31 is equipped with a quick-release foot 60 attached to its bottom surface, which has sidewardly-projecting flanges 61 on each side. As in the first embodiment, light 31 attaches to clinch 7 below. A quick-release lever 62 is rotatably attached to clinch 7, shown here in its open position. Lever 62 rotates about vertical axis A-A', which moves cam 63 about the axis. Note that cam 63 has a straight vertical edge 64 positioned far enough to the left when it is open to allow both flanges 61 of foot 60 to be seated on clinch 7. Also shown here is one of a plurality of contact points 34 which comes into contact with contact pads 35 (not visible in this view) when light 31 is so seated. One of a plurality of clinch bolts 9 are also present.

Figure 7:
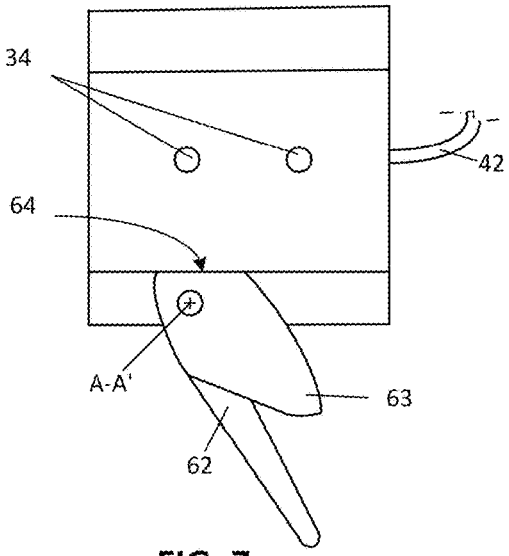
FIG. 7 is a top view of the second embodiment, with the means in the open position.

FIG. 7 is a top view of this second embodiment. The light-affixing means is shown in the open position. Light 31 is not shown in this view to make visible the two contact points 34 in clinch 7 and the flexible pressure switch cable 42 attached to clinch 7 which operate as also described in the first embodiment, and to better illustrate the alternative light-affixing means.

Figure 8:
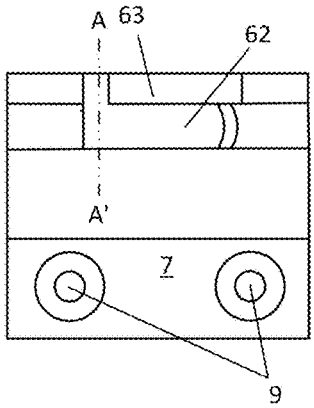
FIG. 8 is a side view of the second embodiment, with the means in the open position.

FIG. 8 is a side view of the second embodiment. The light-affixing means is again shown in the open position.

Figure 9:
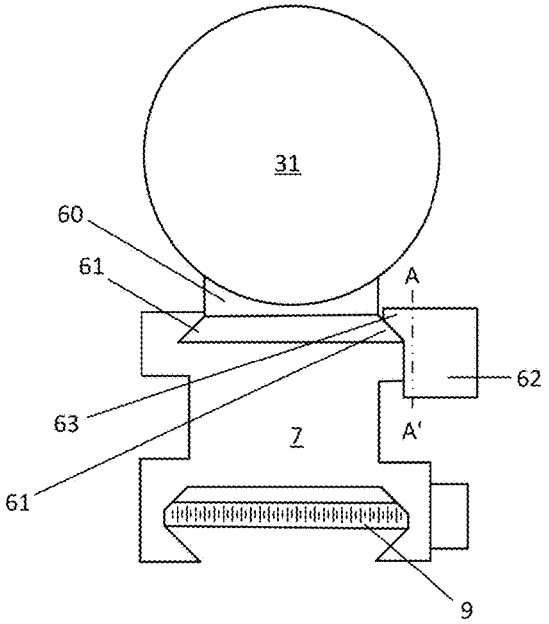
FIG. 9 is an end view of the second embodiment of the invention, with the means for affixing the light in the closed position.

FIG. 9 is an end view of the second embodiment with the light affixing means closed. Lever 62 has been rotated about axis A-A' so that cam 63 prevents the right-hand flange 61 from moving out of position.

Figure 10:
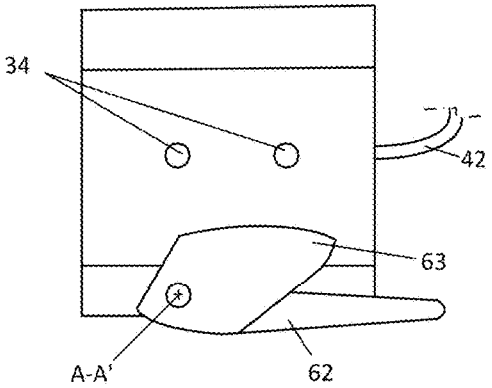
FIG. 10 is a top view of the second embodiment, with the means for affixing the light in the closed position.

FIG. 10 is a top view of the second embodiment. The light-affixing means is shown in the closed position. Cam 63 has been rotated into a position to hold light 31 (not shown for clarity) in place. Lever 62 may be equipped optionally with means biasing it towards this closed position.

Figure 11:
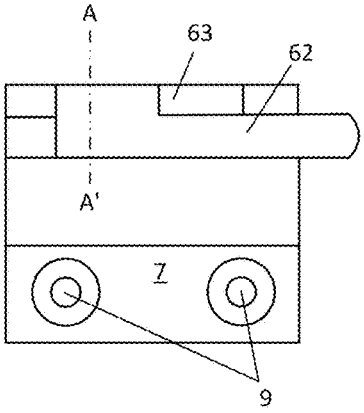
FIG. 11 is a side view of the second embodiment, with the means for affixing the light in the closed position.

FIG. 11 is a side view of the second embodiment, also showing cam 63 in the closed position.

The utility of these embodiments increases the flexibility and options available to the user. In the case of a patrol officer, for example, the light can be in a charging bracket in his vehicle until needed, removed and attached to the weapon and functioned by the pressure switch. The light can still be used as a hand-held flash light and functioned by the switch in the tail-cap or body. The quick release clamp allows the user to remove the light and attach it to another mount/weapon, place it in a charger, or use it as a hand-held light.

The invention claimed is:

1. A light mount, comprising:

a light containing a battery;

the light having a first surface;

the first surface having first electrical contacts;

a clinch removably attachable to a firearm and containing a switch;

the clinch having a second surface and comprising:

a quick release for attaching the light to the clinch;

a pressure switch bulb attached to the clinch by a flexible tube; and second electrical contacts on the second surface;

the first electrical contacts contacting the second electrical contacts when the light is attached to the clinch.

2. The light mount of claim 1, wherein: said light said clinch further comprises battery recharge contacts on said second surface connected within said clinch to said second electrical contacts.

* * * * *